US006345596B1

(12) United States Patent
Kuhl

(10) Patent No.: US 6,345,596 B1
(45) Date of Patent: Feb. 12, 2002

(54) ENGAGEABLE CAM FOLLOWER OR ENGAGEABLE LIFTER ELEMENT

(75) Inventor: Mario Kuhl, Herzogenaurach (DE)

(73) Assignee: Ina Walzlager Schaeffler OHG, Herzogenaurach (DE)

( * ) Notice: Subject to any disclaimer, the term of this patent is extended or adjusted under 35 U.S.C. 154(b) by 0 days.

(21) Appl. No.: 09/541,333

(22) Filed: Apr. 3, 2000

(30) Foreign Application Priority Data

Apr. 7, 1999 (DE) ..... 199 15 532

(51) Int. Cl.[7] ..... F01L 1/12
(52) U.S. Cl. ..... 123/90.16; 123/90.5; 123/198 F
(58) Field of Search ..... 123/90.15, 90.16, 123/90.48, 90.49, 90.5, 90.55, 198 F

(56) References Cited

U.S. PATENT DOCUMENTS

| | | | | | |
|---|---|---|---|---|---|
| 4,911,112 | A | * | 3/1990 | Oikawa et al. | 123/90.16 |
| 4,926,804 | A | * | 5/1990 | Fukuo | 123/90.16 |
| 5,351,662 | A | * | 10/1994 | Dopson et al. | 123/90.16 |
| 5,454,353 | A | * | 10/1995 | Elendt et al. | 123/90.16 |
| 5,720,244 | A | * | 2/1998 | Faria | 123/90.16 |
| 5,782,216 | A | * | 7/1998 | Haas et al. | 123/90.16 |
| 5,832,884 | A | * | 11/1998 | Haas et al. | 123/90.16 |
| 6,164,255 | A | * | 12/2000 | Maas et al. | 123/90.16 |

FOREIGN PATENT DOCUMENTS

| | | |
|---|---|---|
| DE | 4244711 A1 | 3/1994 |
| DE | 4244288 A1 | 5/1994 |
| DE | 4327905 A1 | 2/1995 |
| DE | 4332660 A1 | 3/1995 |
| DE | 19717537 C1 | 12/1998 |

* cited by examiner

*Primary Examiner*—Weilun Lo
(74) *Attorney, Agent, or Firm*—Volpe and Koenig, P.C.

(57) ABSTRACT

An engageable cam follower (1) for acting on a pushrod in the valve train of an internal combustion engine is provided. This cam follower (1) includes of a thin-walled hollow cylindrical housing (2) in whose borehole (3) is positioned an internal element (4) axially movable with respect to the housing (2). The housing (2) and the internal element (4) each possess a radial borehole (13, 10) aligned in a relative position to each other. Positioned in the radial borehole (10) of the internal element (4) is a piston (11) having a convex end (14) and movable toward the radial borehole (13) of the housing (2) for coupling the internal element (4) with the housing (2) in the relative position. According to the invention, the borehole (3) of the housing (2) is shaped in the area of the radial borehole (13) of the housing (2) as a flattening (15) extending in the longitudinal direction of the cam follower (1). This has the advantage that with the piston (11) positioned only slightly in the radial borehole (13) and with initial cam lifting, this piston (11) is load-bearing over a considerable portion of its periphery. As a result, removal of material from the piston (11), such as can occur in the state of the art and which can lead to jamming of the internal element (4) in the housing (2), is no longer encountered.

3 Claims, 1 Drawing Sheet

ENGAGEABLE CAM FOLLOWER OR ENGAGEABLE LIFTER ELEMENT

BACKGROUND

The present invention concerns an engageable cam follower for acting on a pushrod in the valve train of an internal combustion engine or an engageable lifter element for a rocker-arm type of cam follower in the valve train of an internal combustion engine, comprising a thin-walled hollow cylindrical housing in whose borehole is positioned an internal element axially movable with respect to the housing. The housing and the internal element each possess a radial borehole aligned in a relative position to each other and at least one piston movable with its front end toward the radial borehole of the housing being included in the radial boring of the internal element for coupling the internal element with the housing in the relative position.

A lifter element of the general type under consideration here is known from DE-A 197 10 578. This element likewise exhibits a piston arranged in a manner permitting coupling of the internal element with the housing. This piston possesses a convex end on the housing side.

Disadvantageous in the case of the known element is the fact that, under certain operating conditions, one can encounter heavy wear of the piston or its opposing radial borehole in the housing. Such operating conditions can result, for example, should the piston not penetrate sufficiently into the radial borehole of the housing in spite of a triggered shift command. For example, this can be due to insufficient switching time or to an insufficient reduction in the hydraulic pressure during the time window available (in the case of the element considered here as representative of the type, shifting of the piston in the coupling direction occurs via the force of a compression spring). If the piston enters only slightly during initial cam lift into the opposing radial borehole, only two angularly offset lower edges of the piston become engaged due to the geometry of the opposing radial borehole and the borehole of the housing. In the most unfavorable case, this can lead to plastic deformation of the piston or the radial borehole in spite of hardening of the piston or the radial borehole or the use of special materials. In particular, one has to count on cutting of material from the piston. The resulting chips can, in the most unfavorable case, get into the annular chamber between the housing and the internal element and lead to jamming of the internal element in the housing. As a result, the element can no longer be switched (engaged/disengaged) and is incapable of functioning.

SUMMARY

The object of the present invention is therefore to provide a cam follower or lifter element of the type previously known in the art in which the mentioned disadvantages are eliminated.

According to the present invention, this object is attained through the fact that the borehole of the housing is shaped in the area of the mouth of the radial borehole of the housing as a flattening or substantially as a flattening extending in the longitudinal direction of the cam follower or lifter element, the mouth of the radial borehole exhibiting circular geometry.

Through the measures proposed according to the present invention, the most important measure being the circular shape of the mouth at least in the load-bearing area, one insures that the piston entering in the most unfavorable case only partially into the radial borehole of the housing engages over its entire width. In addition, its convex end wall guarantees that the piston, shifted into the problem zone during beginning cam lift, is shoved during initial cam lift back into the radial borehole of the internal element through a developing wedging action. In this way, the disadvantages described above are eliminated via simple means. The undesired coupling position leading to deformation or removal of material at the piston or the radial borehole is no longer encountered. The functional capacity of the cam follower or lifter element is guaranteed over the service life of the internal combustion engine. It is advantageous if the flattening below the mouth runs very close to the mouth. In this way, the load-bearing length of the radial borehole is not unnecessarily shortened.

The flattening is produced by a profiling process such as stamping, eroding, or chamfering. Also conceivable at this point are other manufacturing processes familiar to a person skilled in the art such as milling and the like.

Alternatively it is possible to produce the end of the piston facing the radial borehole of the housing to have a cylindrical shape rather than a convex form. This front end of the piston correlates in radius and in pathway to the borehole of the housing. An important component of the invention here is that the piston is guided in a non-rotational fashion in the radial borehole of the internal element. As a result of this measure, the piston, upon being shifted into the radial borehole of the housing, likewise is load-bearing over a large portion of its lower side in spite of a lack of flattening of the borehole of the housing. Thus, one need not reckon with the disadvantages described above in this case, either. If necessary, an edge area of the piston between the cylindrical surface and the front end can be chamfered or rounded.

Proposed as a simple measure for non-rotational securing the piston in its radial borehole are flattened areas, tongue-and-groove mechanisms, or the like.

The present invention should find preferred application with engageable cam followers such as those for acting on pushrods and with lifter elements. In both cases, it is necessary for space reasons to place the piston in the internal element since the housing possesses only a thin wall and is not advantageously suitable for accepting such coupling means. The protectable range of the present invention also includes, however, directly activable cam followers such as engageable tappets in which the piston is likewise installed in the internal element. The protectable range of the present invention also relates to further couplable and concentrically arranged machine parts outside of the valve-train domain.

BRIEF DESCRIPTION OF THE DRAWINGS

The present invention is appropriately described in more detail on the basis of the drawings. These include.

DETAILED DESCRIPTION OF THE PREFERRED EMBODIMENT

Figure 1:
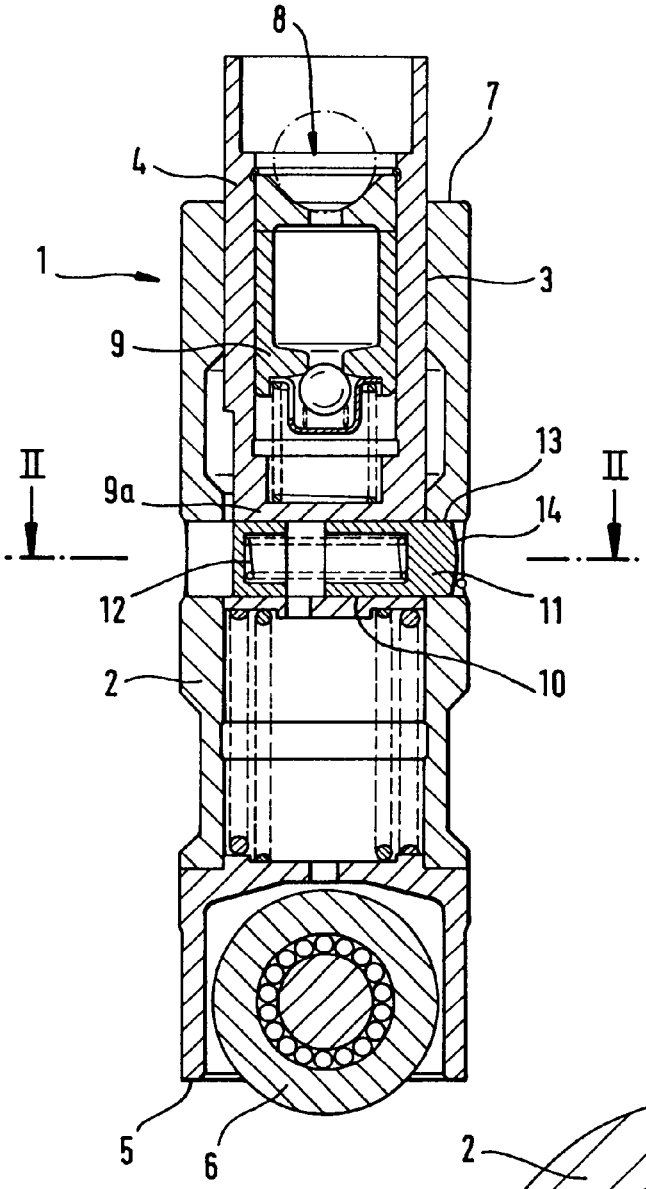
FIG. 1 a longitudinal section through an engageable cam follower.

The present invention is explained in more detail on the basis of an engageable cam follower 1.

The cam follower 1 comprises a hollow cylindrical housing 2 in whose borehole 3 is installed an internal element 4 movable axially to the housing 2. The housing 2 exhibits at its bottom end 5 a roller-bearing-supported roller 6 for direct cam contact. Extending beyond the borehole 3 at the top end 7 of the housing 2 is a bearing surface 8 of the internal element 4 for supporting an end of an unshown pushrod. A known hydraulic lash adjuster 9 is included in the internal element 4.

At its end 9*a* opposite bearing surface 8, the internal element 4 possesses a radial borehole 10. A piston 11 moves as coupling means in the radial borehole 10. A compression spring 12 loads this piston 11 radially outwardly. The housing 2 likewise possesses a radial borehole 13. The housing 2 and the internal element 4 are shown in FIG. 1 as coupled together via the piston 11. The gas-exchange valve indirectly acted on by the pushrod opens during the lifting phase of the cam acting on roller 6. The coupling shown here is appropriately produced during base-circle contact of the unshown cam.

Figure 2:
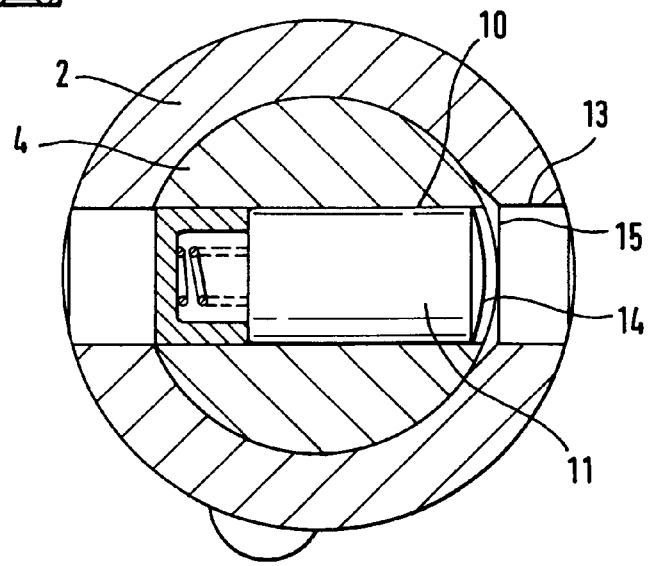
FIG. 2 an enlarged sectional view along line II—II of FIG. 1.

One end 14 of the piston 11 is provided with a convex shape (see also FIG. 2). At the same time, an area of the borehole 3 surrounding the radial borehole 13, standing opposite piston end 14 in the positional state shown in FIG. 1, is shaped as a flattening 15. A mouth of the radial borehole thus exhibits a circular geometry. Should the piston 11 be displaced from the state shown in FIG. 2 to that shown in FIG. 1, i.e., from its radial borehole 10 into radial borehole 13 for the purpose of coupling the internal element 4 with the housing 2, then the piston 11 will always be load-bearing over a large portion of its bottom side upon entering the radial borehole 13. In the most unfavorable case, i.e., with only partial coupling or uncoupling, the piston 11 will be moved completely into radial borehole 10 upon differential lifting of the internal element 4 with respect to housing 2 due to the convex shape of end 14. Due to the flattened area of the borehole 3 with circular mouth, the problem conditions described above as occurring in the most unfavorable case in the state of the art are eliminated by simple means.

LIST OF ELEMENTS

1 cam follower
2 housing
3 borehole
4 internal element
5 bottom end
6 roller
7 top end
8 bearing surface
9 hydraulic lash adjuster
9*a* end
10 radial borehole
11 piston
12 compression spring
13 radial borehole
14 front end
15 flattening

What is claimed is:

1. Engageable cam follower (1) for acting on an element of a valve train of an internal combustion engine or an engageable lifter element for a rocker-arm type of cam follower in the valve train of an internal combustion engine, comprising a thin-walled hollow cylindrical housing (2) having a borehole (3) with a cylindrical inner wall, an internal element (4) axially movable with respect to the housing (2) positioned in the borehole (3), the housing (2) and the internal element (4) each including a radial borehole (13, 10) aligned in a relative position to each other, and at least one piston (11) located in the radial borehole (10) of the internal element (4) having a front end (14) that is movable toward the radial borehole (13) of the housing (2) for coupling the internal element (4) with the housing (2) in the relative position, the cylindrical inner wall of the borehole (3) has a substantially flattened area (15) in an area of a mouth of the radial borehole (13) of the housing (2) that extends in a longitudinal direction of the cam follower (1) or lifter element, so that the mouth of the radial borehole (13) has a circular geometry in the flattened area (15) and the front end (14) of the piston (11) engages in the borehole (13) substantially across an entire width of the piston (11) and the borehole (13) upon entry into the borehole (13) to couple the internal element (4) with the housing (2).

2. Engageable cam follower or lifter element according to claim 1, wherein the front end (14) of piston (11) is provided with a convex shape.

3. Engageable cam follower (1) or lifter element according to claim 1, wherein the flattened area (15) is produced by a profiling process comprising one of stamping, eroding, or chamfering.

* * * * *